United States Patent [19]

Gallusser et al.

[11] Patent Number: 4,478,474

[45] Date of Patent: Oct. 23, 1984

[54] COUPLING NUT FOR AN ELECTRICAL CONNECTOR

[75] Inventors: David O. Gallusser, Oneonta; Ann E. Peterson, Sidney, both of N.Y.

[73] Assignee: Bendix Corporation, Southfield, Mich.

[21] Appl. No.: 431,970

[22] Filed: Sep. 30, 1982

[51] Int. Cl.[3] ..... H01R 13/62

[52] U.S. Cl. ..... 339/89 M; 339/DIG. 2

[58] Field of Search ..... 339/DIG. 2, 90 R, 90 C, 339/89 R, 89 C, 89 M; 285/82, 84, 86, 87, 92; 411/296, 299, 300

[56] References Cited

U.S. PATENT DOCUMENTS

| | | | |
|---|---|---|---|
| 1,887,448 | 11/1932 | Behringer | 411/300 |
| 2,372,884 | 4/1945 | Davis | 411/300 |
| 2,445,125 | 7/1948 | Reyburn | 411/300 |
| 4,268,103 | 5/1981 | Schildkraut et al. | 339/89 M |

FOREIGN PATENT DOCUMENTS

| | | | |
|---|---|---|---|
| 2622214 | 7/1977 | Fed. Rep. of Germany | 411/300 |

*Primary Examiner*—John McQuade

*Attorney, Agent, or Firm*—C. D. Lacina

[57] ABSTRACT

A coupling nut (300) having internal thread (310) adapted to engage external thread (210) on one of a pair of shells (100, 200) for connecting the two shells together into an electrical connector assembly includes an annular groove (350) medial of the thread (310) and a spring member (400) mounted within the groove, spring member (400) comprising an annular band (410) having a plurality of resiliently deflectable cantilever-type spring leafs (440), each spring leaf (440) being arched radially inwardly from band (410) and having a medial portion (444) thereof which is adapted to bias against internal thread (210) advanced across the annular groove of the coupling nut and a free end (442) thereof which is adapted to engage the annular groove to constantly bias medial portion (444) from the groove.

10 Claims, 11 Drawing Figures

FIG. 4
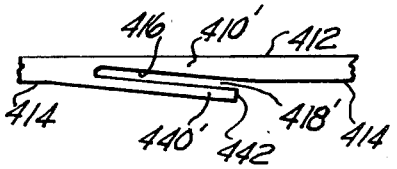
FIG. 3
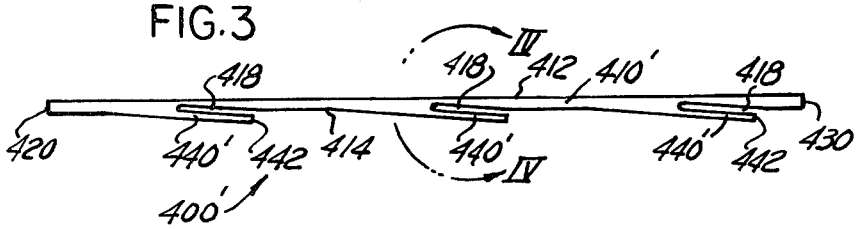
FIG. 5
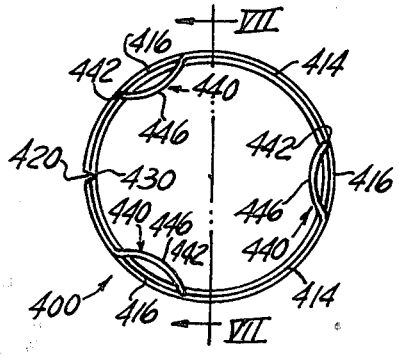
FIG. 6
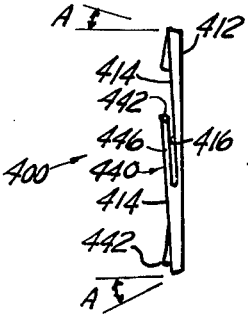
FIG. 7
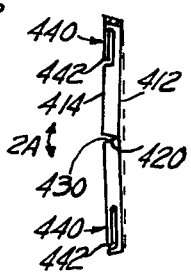
FIG. 8
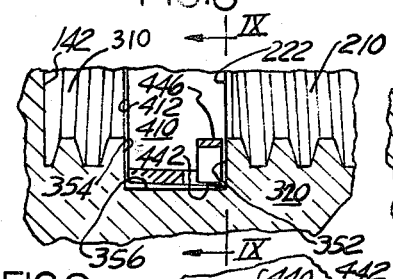
FIG. 10
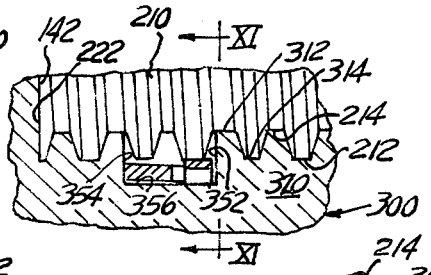
FIG. 9
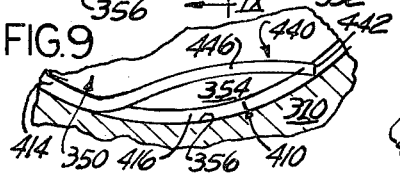
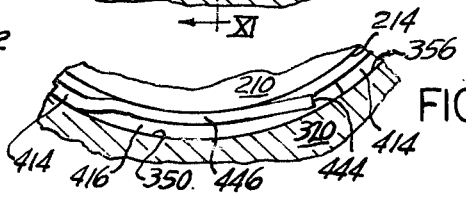
FIG. 11

COUPLING NUT FOR AN ELECTRICAL CONNECTOR

This invention relates to a coupling nut for an electrical connector and more particularly, to a radial compression spring providing resistance to uncoupling.

Electrical connector assemblies are generally comprised of two separate housings, each housing having contacts carried therewithin with the contacts of one housing being mateable with contacts in the other housing when the two housings are connected together by a coupling member. The coupling member is generally mounted to one of the housings by one or more snap rings to captivate a radial flange of the coupling member against an annular shoulder of the one housing. Because coupling engagement is by sliding rotational movement between threads on the coupling nut and on the outer portion of the other connector housing and because the coupling nut is held in place solely by friction between threads, it is not uncommon to find that the coupling nut will tend to loosen under vibrational influences. A desirable connector assembly would include an anti-decoupling device which would hold the coupling nut and the connector housings in place when subjected to vibration, but yet which would allow the coupling nut to be disconnected upon application of reasonable uncoupling torques applied by the user.

A prior anti-decoupling arrangement for resisting unwanted back off of a coupling nut has disposed expensive spring-ratchet devices between an inner wall of the coupling nut and an outer surface of the connector shell. In "Electrical Connector Assembly Having an Anti-Decoupling Mechanism," U.S. Pat. No. 4,109,990 issuing August 29, 1978 to Waldron, et al, four straight spring beams had their opposite ends mounted to the coupling nut and a medial tooth therebetween engage with ratchet teeth disposed around the connector shell to which the coupling nut was mounted. A major limitation of this mechanism is that spring forces constantly wear against the contacted members. Use of such springs and coacting ratchet teeth require that the coacting parts have close tolerances to provide efficient and sure contact therebetween. A less expensive means for resisting unwanted back off of a coupling nut would be desirable.

In accord with this invention, an electrical connector assembly includes a one-piece coupling nut having a tubular shell with a radial flange thereof capitivating the nut for rotation against an annular shoulder of a plug shell and an inner wall thereof including thread adapted to engage with thread on the outer surface of a receptacle shell. In particular, the coupling nut is characterized as including within its thread an annular groove receiving therewithin a radial compression spring comprising an annular band having a plurality of, arched cantilever-type, leaf springs extending radially inwardly therefrom, each leaf spring being arcuate in shape and having its free end disposed against the interior wall of the groove and a medial portion adapted to bias against the receptacle thread to apply inwardly directed radial forces against the receptacle threads upon rotation of the coupling nut to prevent decoupling during vibration and shock exposure.

An advantage of this invention is that it reduces the complexity of necessary parts of an electrical connector assembly. Another advantage of the invention is a reduction in time necessary to assemble a coupling nut.

Another advantage is provision of an anti-decoupling device which may be simply mounted and/or removed from its connector shell. A further advantage of the anti-decoupling device according to this invention is elimination of unnecessary and constant wear during use. Another advantage of this invention is a simply formed radial compression spring member having arched leaf springs which provides anti-decoupling contact only with the mating threads and only when nearly full mate is achieved. Yet another advantage is provision of a spring member which may be removed for repair should the contact leaf spring members be damaged.

One way of carrying out the invention is described in detail below with references to the drawings which illustrate one specific emobodiment of this invention, in which:

FIG. 3 is a metal stamping.

FIG. 4 is an enlarged portion of the stamping taken about lines IV—IV of FIG. 3.

FIG. 5 is the stamping of FIG. 3 formed into a annular spring.

FIG. 6 is a side view of the annular spring of FIG. 5.

FIG. 7 is a section view of the annular spring taken along lines VII—VII of FIG. 5.

FIG. 8 is an enlarged side view, partially in section, of the connector shells being coupled.

FIG. 9 is a section view showing the annular spring taken along lines IX—IX of FIG. 8.

FIG. 10 is an enlarged side view of the connector shells coupled and in a full-mate condition.

FIG. 11 is a section view showing the annular spring at full-mate condition taken along lines XI—XI of FIG. 10.

Figure 1:
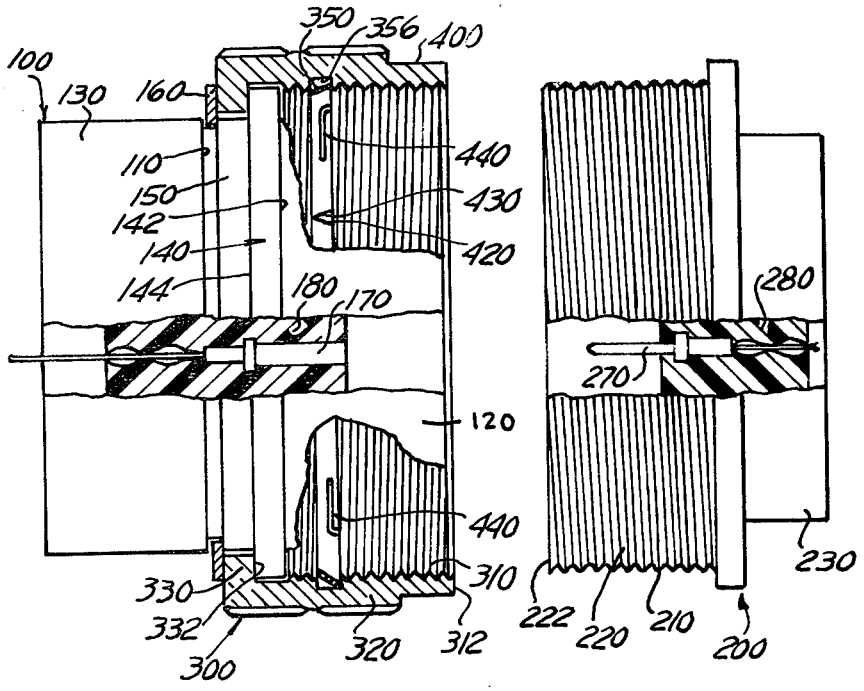
FIG. 1 is a partial section view of a disconnected electrical connector assembly including a pair of mating shells and including a coupling nut in accordance with this invention.

Referring now to the drawings, FIG. 1 illustrates an uncoupled electrical connector assembly in position for mating and comprises a pair of generally cylindrical electrical connector shells 100, 200 and a coupling nut 300 having a radial flange 330 and mounted to first connector shell 100 for coupling to the second connector shell 200 and for retaining the connector shells in a coupled (i.e., mated) condition.

The electrical connector shells 100, 200 are separable and movable from the uncoupled position shown to a coupled position (see FIG. 10). As shown, connector shells 100, 200 are typically referred to as plug and receptacle connectors, respectively. Plug shell 100 includes, respectively, forward and rearward cylindrical portions 120, 130 and an annular shoulder 140 medially of the shell portions, shoulder 140 defining forward and rearward faces 142, 144, rearward portion 130 including a stepped groove 110 for receiving a retaining ring 160 and an annular wall 150 for receiving radial flange 330 of the coupling nut. Similarly, receptacle shell 200 includes, respectively, forward and rearward cylindrical portions 220, 230 with forward portion 220 being coaxial with and adapted to be received about forward portion 120 of plug shell 100, forward portion 220 having a forward end face 222 and including thread 210 on the outer surface thereof.

A duality of electrical contact elements 170, 270 carried by dielectric inserts 180, 280 are mounted, respectively, in each of the respective connector shells 100, 200 and adapted to be mated in the coupled position.

The coupling nut 300 is mounted to plug shell 100 and includes a generally cylindrical forward portion 320 having a front face 312 and coaxial with and adapted to be received about forward portion 220 of receptacle shell 200 and the inwardly extending radial flange 330 defining an interior end wall 332, the inside wall of forward portion 320 being provided with internal thread 310 cooperable with the external thread 210 on the outside of receptacle shell 200, engagement of the respective thread 210, 310 drawing receptacle shell 200 within coupling nut 300 and about plug shell 100 and mating the respective contacts 170, 270. Coupling nut 300 is mounted for rotation to plug shell 100 by means of retaining ring 160 captivating radial flange 330 rearwardly of annular shoulder 140 so that end wall 332 of the radial flange is abutting against rearward face 144 of annular shoulder 140. When coupled and full-mate is achieved (see FIG. 10), forward end face 222 on receptacle shell 200 will be in contact with forward face 142 of shoulder 140.

Preferably and in accord with this invention, coupling nut 300 includes an anti-decoupling device for resisting unwanted back off between shells 100, 200 from their full-mate contact which includes an annular groove 350 disposed within the internal thread 310 and an annular spring member 400 mounted within the annular groove, the thread 310 preferably extending from the front face 312 rearwardly substantially to forward face 142 of annular shoulder 140. Annular groove 350 is disposed approximately two or three thread rotations from full-mate condition wherein the end faces 222, 142 abut and is substantially symmetrical with respect to an axis perpendicular to the axis of rotation of the coupling nut.

Figure 2:
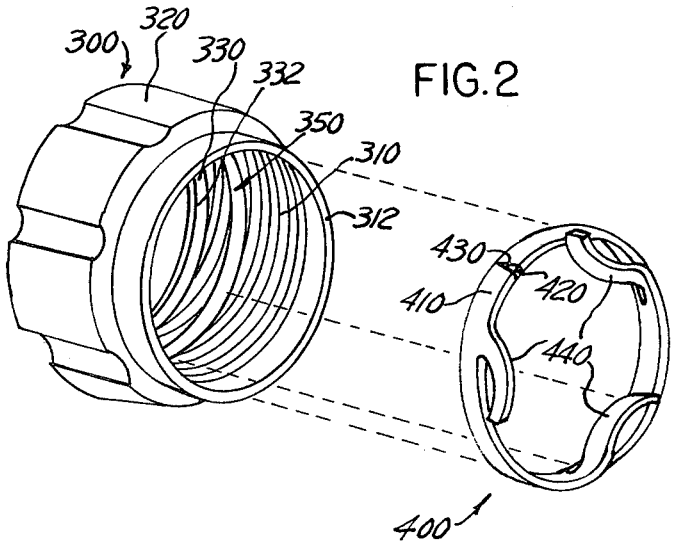
FIG. 2 is an exploded perspective view of the coupling nut of FIG. 1.

FIG. 2 shows coupling nut 300 and annular spring 400 in perspective with the coupling nut including annular groove 350 disposed within internal thread 310 adjacent radial flange 330. Annular spring member 400 comprises a generally flat band 410 having opposite ends 420, 430 formed from a metal blank into a cylindrical ring sized to fit within annular groove 350 and including three arched, cantilever-type, leaf springs 440 disposed generally equiangularly around and extending radially inwardly from the band.

FIG. 3 shows an elongated metal blank 400' for forming the spring 400 as comprising a flat band 410' having spaced, substantially parallel, longitudinal edges 412, 414 and opposite ends 420, 430 with longitudinal edge 412 being substantially straight and longitudinal edge 414 having three slots 418 stamped therein to define three fingers 440' extending therefrom.

FIG. 4 shows detail of one finger 440' extending as a cantilever from band 410', finger 440' and slot 418' being generally straight and rectangular in shape to define a cantilever having a deflectable free end 442 and tapering inwardly from edge 414 towards opposite edge 412. Slot 418' forms a band edge 416 which forms a continuation of longitudinal edge 414 and is in register with finger 440'.

FIG. 5 shows the blank 400' of FIG. 3 formed into annular spring 400 as a result of band 410' being formed into a ring by band ends 420, 430 being brought into partial abutment. The fingers 440' have been formed into leaf springs 440 with each finger 440' of blank 400' being arched radially inwardly from the band 410, each arched leaf spring 440 having free end 442 being disposed substantially about a plane of the band defined by edge 414 and a medial portion 446 being disposed radially inward of band 410. Annular spring 400 is slightly frusto-conical in shape (shown best in FIGS. 6 and 7) and as ends 420, 430 of band 410 are not in complete abutment.

FIG. 6 shows frusto-conical shaped annular spring 400 with band 410 forming an angle "A" about the ring. Preferably, angle "A" would be about 10° with respect to the axis of rotation of the coupling nut.

FIG. 7 shows band ends 420, 430 partially abutting and their ends 420, 430 forming a combined angle "2A" and thus about 20°.

FIGS. 8–11 show a coupling operation during which coupling nut thread 310 engages receptacle shell thread 210 to draw the two shells 100, 200 axially together. Ultimately, at full-mate between the shells 100, 200, metal-to-metal contact is achieved between their respective faces 142 and 222.

In FIG. 8, forward portion 220 of receptacle 200 has advanced into coupling nut 300 to a position immediately adjacent annular groove 350 and annular spring 400. Thread 310 helically advances about the inner wall of the coupling nut and includes, respectively, a contiguous succession of peaks and valleys 312, 314. Annular groove 350 includes, respectively, longitudinally spaced end walls 352, 354 and a radially recessed periphery 356. Tooth valley 314 is disposed radially intermediate tooth peak 312 and recessed periphery 356, annular groove 350 being perpendicular to the axis of rotation of the coupling nut and end walls 352,354 thereof forming a longitudinal gap across helical thread portions.

Spring 400 has band 410 positioned in annular groove 350 with medial portion 446 of arched leaf spring extending radially inwardly of thread peaks 312 and longitudinal edges 412, 414 abutting groove end walls 352, 354, the deflectable free end 442 of leaf spring substantially abutting recessed periphery 356 of the groove. Spring 400 is mounted in groove 350 in pressure-tight relationship.

FIG. 9 shows one arched leaf spring 440 prior to full mating and adjacent internal thread 210 on receptacle shell 200.

In FIGS. 10 and 11, receptacle thread 210 has advanced across the gap defined by annular groove 350, so that the peaks of thread 210 thereby engage the midpoint or medial portion 446 of arched leaf spring 440 of annular spring member 400 to radially depress leaf spring 440 downwardly into annular groove 350 (i.e. radially outwardly of the primary axis of the connector assembly) and to abut free end 442 thereof against recessed periphery 352 of the annular groove, medial portion 446 biasing against a surface portion of the receptacle shell thread form 210. Annular springs 400 resist uncoupling movement of coupling nut 300 by applying additional radial friction force to thread surfaces contacted. This added force will prevent decoupling during vibration and shock exposure. FIG. 10 shows, in particular, full mate wherein end face 222 of receptacle shell 200 is in metal-to-metal contacct with forward face 142 of annular shoulder 140 on plug shell 100. The frusto-conical shape of annular spring 400 tends to bias band 410 radially outwardly upon engagement by receptacle thread 210.

Although the description of this invention has been given with reference to a particular embodiment, it is not to be construed in any limited sense, many variations and modifications may occur to those skilled in the art.

We claim:

1. A coupling nut for an electrical connector comprising: a pair of mating shells, the coupling nut being captivated for rotation about one of the shells and provided with first thread (310) for threadably coupling with complementary second thread (210) disposed on the other of said shells, said coupling nut characterized by: an annular groove (350) disposed medially within said first thread (310); and an anti-decoupling device (400) for resisting uncoupling of said electrical connector shells, including an annular spring band (410) in said annular groove and a resilient spring member (440) extending radially inward from the annular groove for biasing radially against the second thread (210), said spring member comprising an arched leaf spring extending from the spring band as a cantilever and including a free end (442) to engage the annular groove (350) and a medial portion (446) to radially engage the surface of the second thread (210).

2. The coupling nut as recited in claim 1, characterized in that said annular spring band (410) forms a frusto-conical shape with respect to the axis of said electrical connector.

3. The coupling nut as recited in claim 1, characterized in that three like arched leaf springs (440) are disposed generally equiangularly around said spring band (410).

4. The coupling nut as recited in claim 1, characterized in that said annular groove (350) is disposed at least one or two thread advances of thread (310) from mating face (142) of the one shell (100).

5. A coupling nut for use with an electrical connector of the type having a shell (100) having a central axis, a forward portion (120), at least one electrical contact (270) mounted in said shell and an annular shoulder (140) having a forward face (142), said coupling nut having a flange (330) disposed about the annular shoulder and a forward portion (320) having thread (310) operating to connect to second thread (210) on a similar second shell (200) having at least one electrical contact (170) to thereby mate said contacts (120, 270), said coupling nut characterized by:

said forward portion (320) having an annular groove (350) extending around the inner wall thereof and within the thread (310); and an annular band (410) expanded in said annular groove (350) in pressure tight relationship, said annular band including at least one leaf spring (440) extending radially inward therefrom, said leaf spring (440) being resiliently and radially deflectable inwardly of said annular groove (350) and outwardly from the central axis of said coupling nut, said leaf spring having a medial portion (446) thereof extending inwardly to bias against peaks of thread (210) formed around the mating second shell, each leaf spring being arcuate and having a free end (442) adapted to engage the annular groove to resist deflection of the leaf spring (440) therein upon engagement of the thread peaks by the medial portion (446).

6. The coupling nut as recited in claim 5, characterized in that a plurality of like leaf springs (440) extend radially inwardly from annular band (410).

7. The coupling nut as recited in claim 5, wherein annular groove (350) includes spaced end faces (352, 354) to define a longitudinal gap across thread (310), each said thread (210, 310) forming, respectively, a contiguous succession of peaks (212, 312) and valleys (214, 214) except for longitudinal gap formed by annular groove (350) in thread (310), characterized in that medial portion (446) of each leaf spring (440) normally extends from annular groove (350) radially inwardly of peaks (312) towards the connector axis prior to mating and radially outwardly of valleys (314) from the axis towards annular groove (350) after mating, free end (442) engaging annular groove (350) in each case.

8. An electrical connector of the type including a cylindrical shell (100); an insert (180) of dielectric material having an electrical contact (170) mounted therein; a coupling nut (300) rotatably mounted to said shell (100), said coupling nut (300) having a tubular forward portion (320) with internal thread (310) adapted to mate with external thread (210) on another shell (200) having electrical contact (270) mounted therein so that said shells (100, 200) are connected together with their respective contacts (170, 270) held in a mated relationship; and means (350, 400) operative only near a full-mate condition for resisting rotational movement of the coupling nut, said means for resisting rotational movement of the coupling nut characterized by:

an annular groove (350) disposed in said coupling nut internal thread (310); and an annular ring (400) including a band (410) of metal expanded in said annular groove (350) in pressure tight relationship, said ring (400) including a leaf spring (440) which has one end thereof secured to the band (410), a free end (442) disposed against the annular groove (350), and a medial portion (444) adapted to bias against the thread (210) .

9. The electrical connector as recited in claim 8 wherein said annular ring (400) includes a plurality of said leaf springs (440), each leaf spring (440) being disposed equiangularly around the band (410).

10. The electrical connector as recited in claim 9 wherein said leaf springs form arched cantilevers.

* * * * *